US012467180B2

(12) United States Patent
Borgerson et al.

(10) Patent No.: US 12,467,180 B2
(45) Date of Patent: Nov. 11, 2025

(54) FOREIGN PARTICULATE REMOVAL ASSEMBLY

(71) Applicant: WHIRLPOOL CORPORATION, Benton Harbor, MI (US)

(72) Inventors: Matthew Edward Borgerson, St. Joseph, MI (US); Mark Jason Christensen, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 368 days.

(21) Appl. No.: 17/961,173

(22) Filed: Oct. 6, 2022

(65) Prior Publication Data

US 2023/0146075 A1 May 11, 2023

Related U.S. Application Data

(60) Provisional application No. 63/278,161, filed on Nov. 11, 2021.

(51) Int. Cl.

| | |
|---|---|
| ***D06F 33/37*** | (2020.01) |
| ***D06F 25/00*** | (2006.01) |
| ***D06F 39/02*** | (2006.01) |
| ***D06F 39/10*** | (2006.01) |
| ***D06F 58/20*** | (2006.01) |
| ***D06F 58/22*** | (2006.01) |
| ***D06F 58/44*** | (2020.01) |
| *D06F 103/08* | (2020.01) |
| *D06F 105/30* | (2020.01) |

(Continued)

(52) U.S. Cl.

CPC ..... *D06F 33/37* (2020.02); *D06F 25/00* (2013.01); *D06F 39/022* (2013.01); *D06F 39/10* (2013.01); *D06F 58/203* (2013.01); *D06F 58/22* (2013.01); *D06F 58/44* (2020.02); *D06F 2103/08* (2020.02); *D06F 2105/30* (2020.02); *D06F 2105/38* (2020.02); *D06F 2105/42* (2020.02)

(58) Field of Classification Search

CPC ..... D06F 33/37; D06F 39/022; D06F 39/10; D06F 2103/08; D06F 2105/42; D06F 2105/30; D06F 58/203; D06F 25/00; D06F 58/44; D06F 2105/38; D06F 58/22

See application file for complete search history.

(56) References Cited

U.S. PATENT DOCUMENTS

| | | |
|---|---|---|
| 3,172,604 A | 3/1965 | Brock |
| 3,872,604 A | 3/1975 | Keller |

(Continued)

FOREIGN PATENT DOCUMENTS

DE 102017104284 A1 5/2018

*Primary Examiner* — Michael E Barr
*Assistant Examiner* — Lauren G Orta
(74) *Attorney, Agent, or Firm* — Price Heneveld LLP

(57) ABSTRACT

A foreign particulate removal assembly for a laundry appliance includes a cabinet and a drum that is disposed within the cabinet. The drum includes a humidity sensor. The foreign particulate removal assembly further includes a fluid emitting feature that is operably coupled to a fluid housing proximate the drum. The fluid emitting feature is configured to selectively dispense fluid into the drum. A controller is communicatively coupled with the fluid emitting feature. The controller is configured to activate the fluid emitting feature when the humidity sensor detects a predetermined wetness of clothing items disposed within the drum.

20 Claims, 5 Drawing Sheets

(51) Int. Cl.
*D06F 105/38* (2020.01)
*D06F 105/42* (2020.01)

(56) References Cited

U.S. PATENT DOCUMENTS

| | | | | |
|---|---|---|---|---|
| 4,207,683 | A | 6/1980 | Horton | |
| 4,236,320 | A | 12/1980 | Schwadike et al. | |
| 7,392,600 | B2 | 7/2008 | Gerlach et al. | |
| 7,921,578 | B2 | 4/2011 | McAllister et al. | |
| 8,819,959 | B2 | 9/2014 | Klug et al. | |
| 9,267,229 | B2 | 2/2016 | Oh et al. | |
| 2009/0178295 | A1 | 7/2009 | He et al. | |
| 2011/0016928 | A1* | 1/2011 | Beihoff | D06F 58/203 68/19 |
| 2018/0038037 | A1* | 2/2018 | Hui | D06F 33/06 |
| 2020/0308755 | A1* | 10/2020 | Leibman | D06F 39/12 |
| 2021/0198834 | A1* | 7/2021 | Hammond | D06F 25/00 |

* cited by examiner

FOREIGN PARTICULATE REMOVAL ASSEMBLY

CROSS REFERENCE TO RELATED APPLICATION

This application claims the benefit under 35 U.S.C. § 119(e) to U.S. Provisional Patent Application No. 63/278,161, filed on Nov. 11, 2021, entitled "FOREIGN PARTICULATE REMOVAL ASSEMBLY," which is incorporated herein by reference in its entirety.

BACKGROUND OF THE DISCLOSURE

The present disclosure generally relates to a laundry appliance, and more specifically, to a foreign particulate removal assembly for a laundry appliance.

SUMMARY OF THE DISCLOSURE

According to an aspect of the present disclosure, a foreign particulate removal assembly for a laundry appliance includes a cabinet, a drum that is disposed within the cabinet and has a processing space defined therein, a moisture sensor in communication with the processing space, a fluid housing that is disposed within the cabinet proximate the drum, and a fluid emitting feature that is operably coupled to the fluid housing and positioned proximate the drum. The fluid emitting feature selectively delivers a particulate separating fluid from the fluid housing and onto the processing space of the drum. The fluid emitting feature is in communication with the moisture sensor and the fluid emitting feature activates when the moisture sensor senses a threshold level of moisture within the processing space.

According to another aspect of the present disclosure, a foreign particulate removal assembly for a laundry appliance includes a cabinet, a drum that is disposed within the cabinet and has a processing space defined therein, a blower that delivers process air through an airflow path that includes the processing space, a moisture sensor in communication with the processing space, a fluid housing that is disposed within the cabinet proximate the drum, a fluid emitting feature that is operably coupled to the fluid housing and positioned proximate the drum, and a controller that is communicatively coupled with the fluid emitting feature and the moisture sensor. The controller is configured to activate the fluid emitting feature when the moisture sensor detects a threshold level of moisture within the processing space. The fluid emitting feature selectively delivers a particulate separating fluid from the fluid housing and onto the processing space of the drum.

According to another aspect of the present disclosure, a foreign particulate removal assembly for a laundry appliance includes a cabinet, a drum that is disposed within the cabinet and has a processing space defined therein, a blower that delivers process air through an airflow path that includes the processing space, a moisture sensor in communication with the processing space, a fluid housing that is disposed within the cabinet proximate the drum, and a fluid emitting feature that is operably coupled to the fluid housing and positioned proximate the drum. The fluid emitting feature selectively delivers a particulate separating fluid from the fluid housing and onto the processing space of the drum. The particulate separating fluid is delivered at a start of a pet hair cycle and intermittently delivers additional amounts of the particulate separating fluid during performance of the pet hair cycle.

These and other features, advantages, and objects of the present disclosure will be further understood and appreciated by those skilled in the art by reference to the following specification, claims, and appended drawings.

Figure 1:
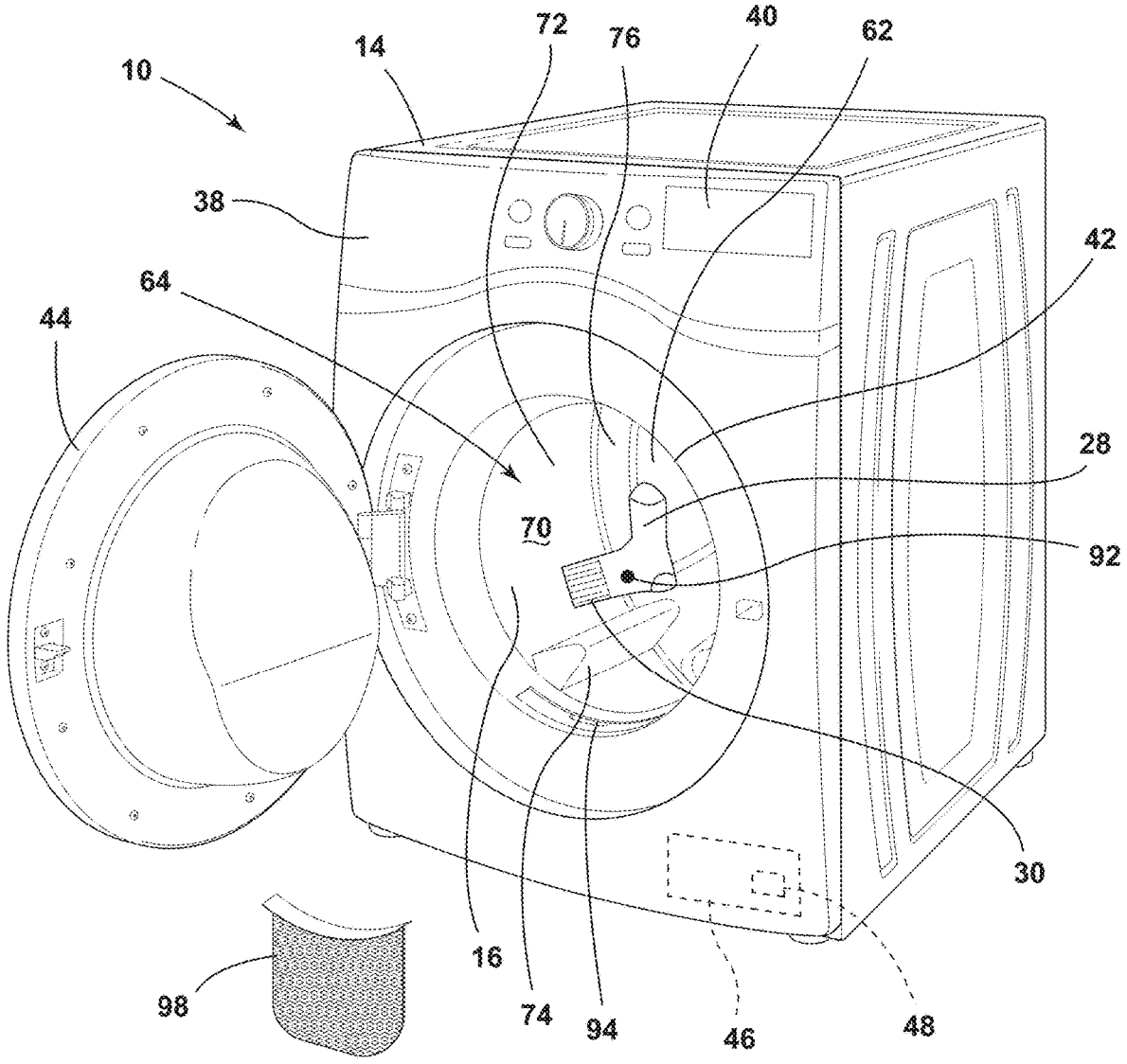
FIG. 1 is a front perspective view of a laundry appliance of the present disclosure.

The components in the figures are not necessarily to scale, emphasis instead being placed upon illustrating the principles described herein.

DETAILED DESCRIPTION

The present illustrated embodiments reside primarily in combinations of method steps and apparatus components related to a foreign particulate removal assembly for laundry appliance. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a . . . " does not, without more constraints, preclude the existence of additional identical elements in the process, method, article, or apparatus that comprises the element.

Referring to FIGS. 1-5, reference numeral 10 generally designates a foreign particulate removal assembly for a laundry appliance 12 that includes a cabinet 14 and a drum 16 disposed within the cabinet 14. The drum 16 includes a moisture sensor 18, such as a humidity sensor, conductivity sensor or other similar sensing device. A fluid housing 20 is disposed within the cabinet 14 proximate the drum 16. A fluid 22, which can be in the form of a particulate separating fluid, is disposed within the fluid housing 20. A fluid emitting feature 24 is operably coupled to the fluid housing 20 proximate the drum 16. The fluid emitting feature 24 is configured to selectively dispense the fluid 22 into the drum 16. A controller 26 is communicatively coupled with the fluid emitting feature 24 and is configured to activate the fluid emitting feature 24 when the moisture sensor 18 detects a predetermined wetness, such as a threshold level of moisture within the processing space and within the articles 28, such as clothing items, disposed within the drum 16. In certain aspects of the device, the threshold level of moisture is typically indicative of a predetermined ratio of wash fluid 30 present within articles 28 being processed within the processing space. This ratio can be measured through measurements taken by the moisture sensor. The wash fluid 30 is typically the water and/or cleaning chemistry that is present within the articles 28 after completion of a wash cycle that may have taken place in the same appliance or within a separate washing appliance. The wash fluid 30 can be in the form of water alone or in combination with detergent, oxi or bleach, fabric softener and other cleaning chemistry. Over the course of a washing laundry cycle, the wash fluid 30 can accumulate particulate and soil that is gathered from the laundry. When the articles 28 are processed as part of a drying cycle, and in particular, the pet hair cycle 134, the capture of particulate within the articles 28 can be achieved, in part, through the use of the fluid 22, as described herein.

Figure 2:
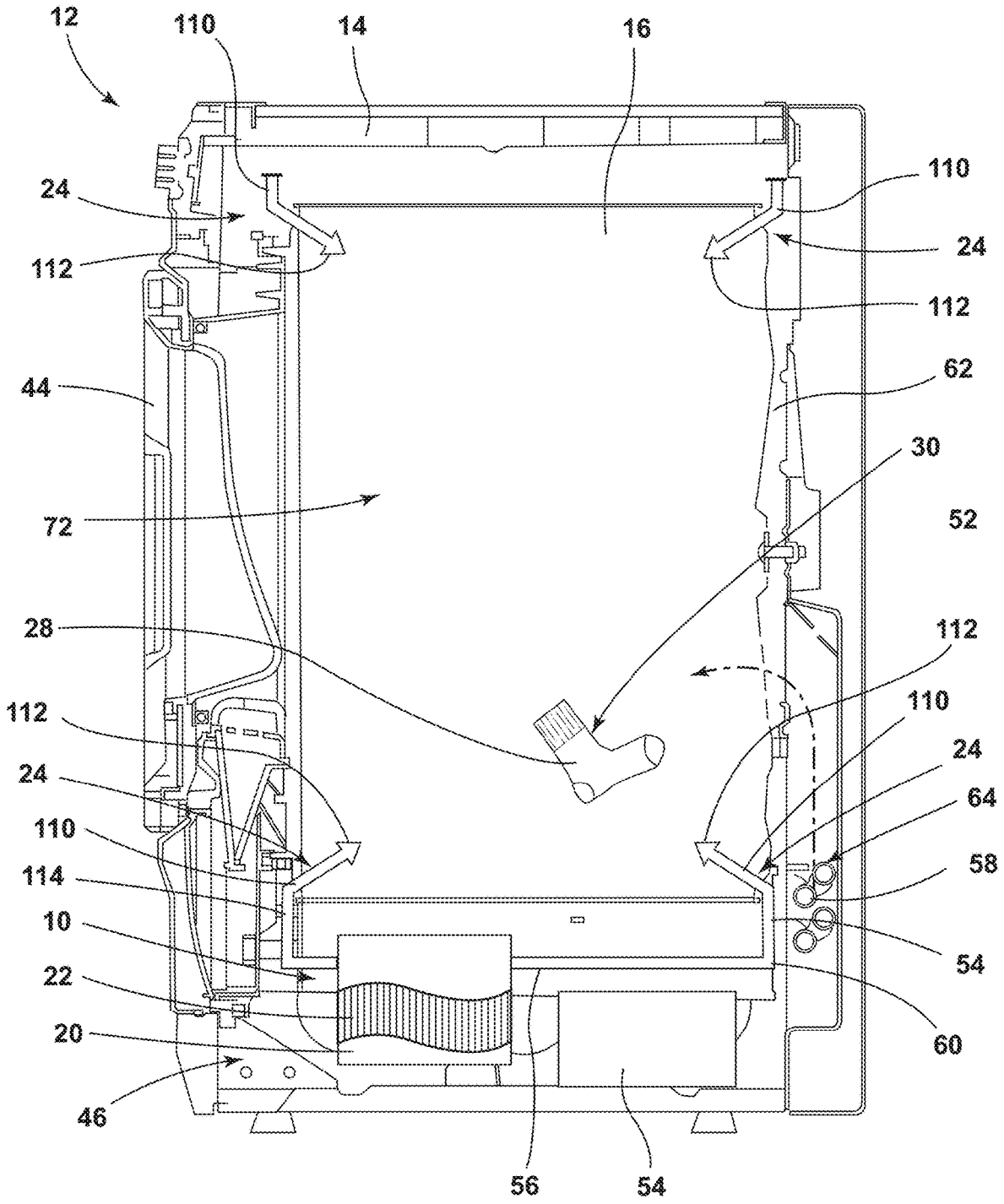
FIG. 2 is a side cross-sectional view of a laundry appliance with a foreign particulate removal assembly of the present disclosure.
Figure 3:
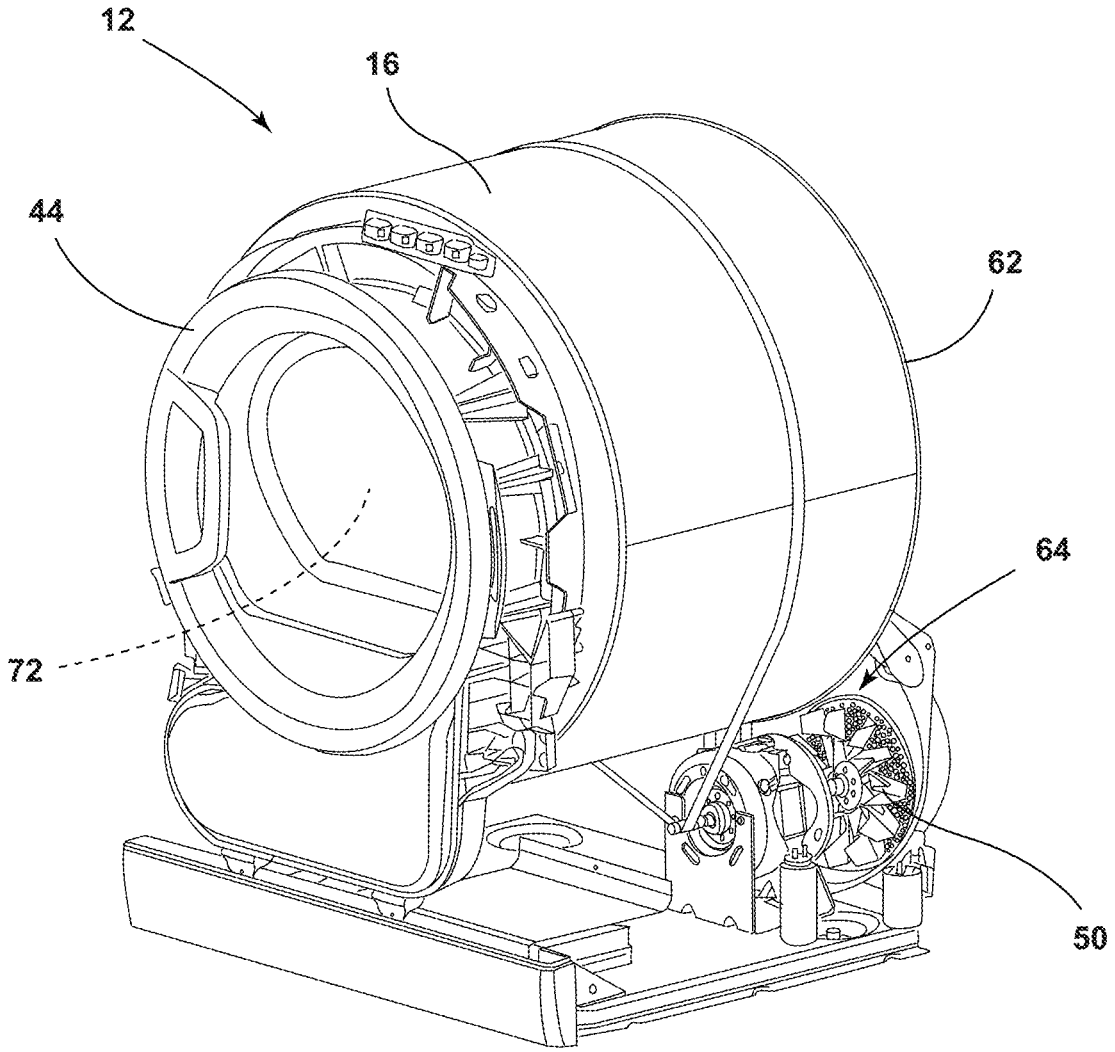
FIG. 3 is a front perspective view of a drum and a blower of the present disclosure.

Referring to FIGS. 1-3, the laundry appliance 12 is illustrated as a frontload laundry appliance, such that the laundry appliance 12 may be a washer, dryer, combination washer/dryer, refreshing device, and other similar appliance for treating articles 28 of laundry. It is also contemplated that the laundry appliance 12 can include various mechanisms for washing, drying, or otherwise processing various non-laundry articles. In the case of a laundry appliance, the appliance can be in the form of a vented-type appliance or a recirculating-type appliance that may include one or more heat-exchange mechanisms.

Referring again to FIGS. 1-3, the cabinet 14 of the laundry appliance 12 includes a front portion 38 that includes a user interface 40 and defines an opening 42. A door 44 is coupled to the front portion 38 of the cabinet 14 and is configured to provide selective access to the drum 16 via the opening 42. The cabinet 14 also includes a machine compartment 46 that may be at least partially defined by the front portion 38 of the cabinet 14. Various mechanical equipment 48 are typically be disposed within the machine compartment 46 including, but not limited to, a blower 50 configured to circulate process air 52 through a rear wall 62 of the drum 16 and into the drum 16 and a heater 54 or other heat exchange mechanism configured to heat and/or cool the process air 52, as described herein. It is also contemplated that the fluid housing 20 can be disposed within the machine compartment 46 proximate to the drum 16. Additionally or alternatively, the fluid housing 20 may be disposed in alternate locations within the cabinet 14 while being proximate to the drum 16.

The fluid housing 20 can be used to deliver the fluid 22 to the fluid emitting feature 24 using the force of gravity. In such an aspect of the device, the fluid housing 20 can be positioned above the fluid emitting feature 24 and certain operable valves can be manipulated to release the fluid for producing a gravity-fed flow of the fluid 22 from the fluid housing 20 the to the fluid emitting feature 24. It is also contemplated that the fluid 22 can be delivered from the fluid housing 20 to the fluid emitting feature 24 using a dedicated fluid pump or other pressure/suction producing mechanism. In such an aspect of the device, the fluid housing 20 can be positioned at various positions within the cabinet that may be above, below or level with the fluid emitting feature 24. In certain aspects of the device, it is contemplated that the fluid housing 20 can be positioned proximate a chemistry dispensing system such that it is possible to locate consumables and receptacles for receiving the consumables in a single general area of the appliance.

The fluid housing 20 can be configured as a receptacle to contain the fluid 22 within the cabinet 14. The fluid housing 20 is operably coupled to the fluid emitting feature 24 via a hose 56, a pipe or other conduit. The fluid housing 20 is configured to store the fluid 22 for dispersion by the fluid emitting feature 24. In operation, the fluid housing 20 supplies the fluid 22 to the fluid emitting feature 24 via the hose 56. The hose 56 can include a continuous section or may include a first extension 58 and a second extension 60, described further herein, that couple to the fluid emitting feature 24. It is generally contemplated that the hose 56 and the fluid emitting feature 24 may be coupled to a fixed portion of the drum 16, such as the rear wall 62. For example, the fluid emitting feature 24 may be coupled to a rear wall 62 of the laundry appliance 12 through which the process air 52 may pass. It is also contemplated that when the laundry appliance 12 can be a combination washer and dryer. In such an aspect of the device, the hose 56 may be coupled to a fixed tub of the laundry appliance 12.

In certain aspects of the device, the fluid emitting feature 24 may rotate or at least partially rotate along with the drum 16 about the rotational axis. Additionally or alternatively, the hose 56 may be selectively coupled and uncoupled from the fluid emitting feature 24 during operation of the laundry appliance 12. The drum 16 is configured to rotate within the cabinet 14 during various laundry cycles of the laundry appliance 12.

With further reference to FIGS. 1-3, the drum 16 has a sidewall 70 that defines a processing space 72 and may include lifters 74 coupled to the sidewall 70 of the drum 16. The lifters 74 lift and otherwise assist in articulating the articles 28 within the drum 16. It is generally contemplated that the fluid emitting feature 24 may be at least partially disposed within the drum 16 proximate at least one of the lifters 74. The fluid emitting feature 24 may extend through the sidewall 70 proximate one of the lifters 74. It is also contemplated that each lifter 74 may have a fluid emitting feature 24 positioned proximate the lifter 74. It is further contemplated that the fluid emitting feature 24 may be disposed within and extend from the lifters 74. The fluid emitting features 24 are directed toward a center 76 of the drum 16 to evenly distribute the fluid on the articles 28, as described herein.

Referring still to FIGS. 1-3, the blower 50 of the laundry appliance 12 can be a fan, an air-handling unit, and/or another air-moving device that can move the process air 52 through the processing space 72. It is generally contemplated that the process air 52 from the blower 50 ultimately follows an airflow path 64 that extends through and within the processing space 72. The heater 54 typically cooperates with the blower 50 to heat or otherwise condition the process air 52 in the airflow path 64. For example, the heater 54 can include various air-conditioning mechanisms including one or more heat exchangers, electrical heaters, heat pump mechanisms, and other similar mechanisms that serve to heat and/or, in certain applications, cool the process air within the processing space 72.

It is generally contemplated that the heater 54 is part of the foreign particulate removal assembly 10, which is configured to remove foreign particulates 92 from the articles 28 within the laundry appliance 12. The foreign particulate removal assembly 10 also includes the fluid housing 20 and the fluid emitting feature 24. The foreign particulate removal assembly 10 can also include a filter housing 94 proximate the drum 16 and the opening 42. It is also contemplated that the filter housing 94 can be positioned in various locations in the laundry appliance 12, so long as the filter housing 94 is at least partially disposed within the airflow path 64 that delivers the process air 52. The filter housing 94 may be integrally formed within the cabinet 14 and may include slots through which the process air 52 may pass. An air filter 98 can be disposed within the filter housing 94 and is configured to collect the foreign particulates 92 from the process air 52 and can subsequently collect the foreign particulates 92 on the air filter 98. It is contemplated that the air filter 98 can be in the form of a removable mesh filter that is positioned within the airflow path 64.

With reference now to FIGS. 2-5, the fluid emitting feature 24 includes a body 110 and a nozzle 112 coupled to the body 110. The fluid emitting feature 24 can also include a fluid supply conduit 114 configured to deliver the fluid 22 into the body 110. The fluid supply conduit 114 can be coupled to and/or otherwise formed with the hose 56, mentioned herein. It is generally contemplated that the fluid emitting feature 24 can be positioned in various locations that are proximate the drum 16, as described herein. The fluid emitting feature 24 dispenses the fluid 22 into the processing space 72 and onto the articles 28. For example, the fluid emitting feature 24 may be coupled to the drum 16 and/or the door 44 of the laundry appliance 12. The fluid emitting feature 24 can direct the fluid 22 into the processing space 72 to ultimately be dispensed on the articles 28. It is also contemplated that the laundry appliance 12 can include a plurality of fluid emitting features 24.

According to the various aspects of the device, the fluid emitting feature 24 can operate to dispense the fluid 22 into the drum 16 during a rotational operation of the drum 16 about a rotational axis of the drum 16. This operation of the drum can be a clockwise rotation, counterclockwise rotation, a stationary state, and combinations thereof. In this manner the operation of the drum can be in the form of a predetermined pattern of operation that is used during the pet hair cycle 134.

It is further contemplated that the fluid emitting feature 24 can include a plurality of fluid supply conduits 114. For example, each fluid supply conduit 114 can supply the same fluid 22 and/or a different fluid 22. Additionally or alternatively, the fluid emitting feature 24 can include the plurality of nozzles 112 coupled to at least one body 110. It is generally contemplated that the fluid supply conduits 114 can be coupled to the hose 56 to translate the fluid 22 from the fluid housing 20 through the nozzles 112. The hose 56 may be integrally formed with each of the fluid supply conduits 114 and/or may include a plurality of hoses 56 separately coupled to each fluid supply conduit 114.

With further reference to FIGS. 2-5, the fluid 22 dispensed by the fluid emitting feature 24 may include, but is not limited to, an anti-static spray, a mixture or solution of water and vinegar, an air mixture, an fluid-air solution, and/or a mixture of various combinations and permutations of these components, as well as other static-mitigating substances. For example, the fluid 22 supplied may be in the form of an anti-static spray via the fluid supply conduit 114, and the fluid emitting feature 24 can utilize the nozzle 112 to disperse the anti-static spray 22 into the processing space 72, such as a fog, vapor, aerosol, or other fine mist. It is also contemplated that the fluid 22 can be a pressurized fluid, such as a pressurized air mixture. It is generally contemplated that the user may input the direction in which the fluid emitting features 24 may be directed. This direction can be dictated through modifying the rotational operation of the drum 16 between a static non-rotating state, a clockwise rotation, and a counterclockwise rotation. Additionally, where a plurality of nozzles 112 of the fluid emitting features 24 are present, certain nozzles can be operated and other nozzles 112 can be left idle. Over the course of the pet hair cycle 134, the operation of the drum 16 and the operation of the nozzles 112 can change to provide a wide range of rotational patterns of the drum 16 and spray patterns of the fluid emitting feature 24. For example, the user may input via the user interface 40 (FIG. 1) of the laundry appliance 12 a desired direction. Additionally or alternatively, the laundry appliance 12 may be configured to adjust the direction of the fluid emitting features 24 and the rotational operation of the drum 16 throughout the cycle.

Referring still to FIGS. 2-5, the laundry appliance 12 includes the controller 26 that can adjust the direction and operation of the fluid emitting features 24 and the drum 16. The controller 26 includes a memory 122 that can be configured with routines 124. The controller 26 may also be configured with a processor 126 and other control circuitry. The processor 126 is configured to execute the routines 124 stored in the memory 122 based on the data and/or communications received by the controller 26.

The other control circuitry of the controller 26 may include communication circuitry 128 for bidirectional communication. For example, the controller 26 may be communicatively coupled with a wireless communication interface 130, described herein, via the communication circuitry 128. While the memory 122 can be included within the controller 26, cloud storage, or other remotely accessible memory interfaces can also be used instead of or in combination with the memory 122.

The wireless communication interface 130 may be implemented via one or more direct or indirect nonhierarchical communication protocols, including but not limited to, Bluetooth®, Bluetooth® low energy (BLE), Thread, Ultra-Wideband, Z-wave, ZigBee, etc. Additionally, the communication interface 130 may correspond to a centralized or hierarchal communication interface 130 where one or more of the devices communicate via a wireless router (e.g., a communication routing controller). Accordingly, the communication interface 130 may be implemented by a variety of communication protocols, including, but not limited to, global system for mobile communication (GSM), general packet radio services, code division multiple access, enhanced data GSM environment, fourth-generation (4G) wireless, fifth-generation (5G) wireless, Wi-Fi, world interoperability for wired microwave access (WiMAX), local area network, Ethernet, etc. By flexibly implementing the communication interface 130, the various devices and servers may be in communication with one another directly via the wireless communication interface 130 or a cellular data connection.

The controller 26 disclosed herein may include various types of control circuitry, digital or analog, and may include a processor, a microcontroller, an application specific integrated circuit (ASIC), or other circuitry configured to perform the various inputs or outputs, control, analysis, or other functions described herein. The memory described herein may be implemented in a variety of volatile and nonvolatile memory formats. Routines may include operating instructions to enable the various methods described herein.

Figure 4:
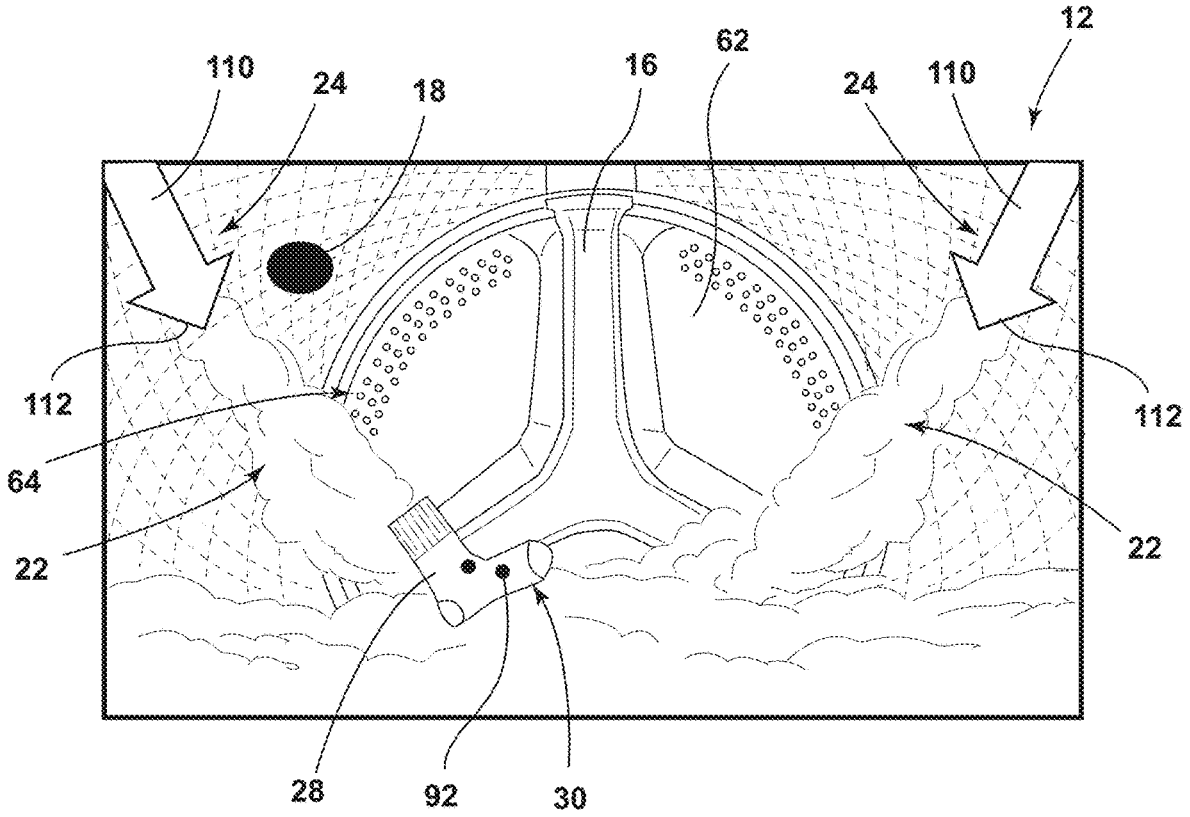
FIG. 4 is an enlarged partial front perspective view of a drum with fluid emitting features of the present disclosure.
Figure 5:
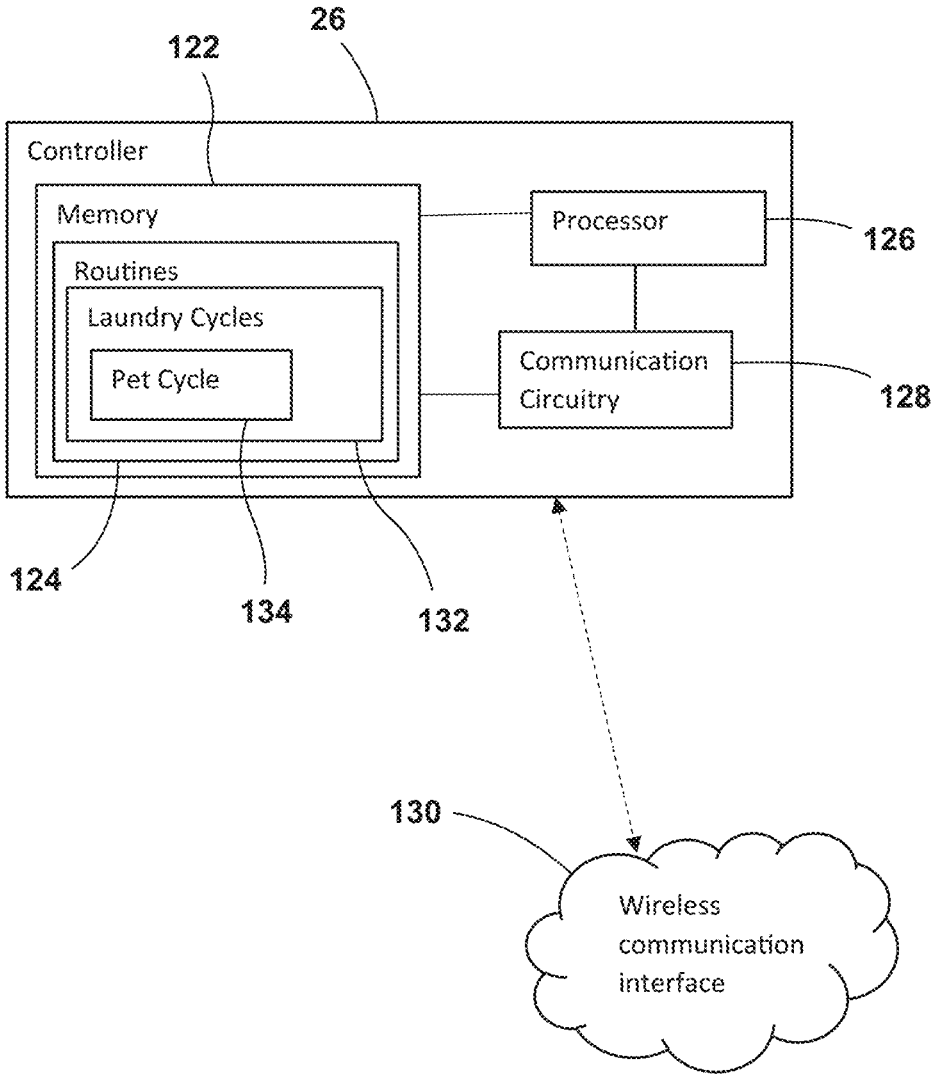
FIG. 5 is a schematic block diagram of a controller of a laundry appliance of the present disclosure.

Referring still to FIGS. 3-5, the routines 124 configured in the memory 122 of the controller 26 include various laundry cycles 132. The laundry cycles 132 can include various cycles that include, but are not limited to, a pet hair cycle 134 or other similar particulate removal cycle. The laundry cycles 132 may also include night cycles, quiet cycles, and/or other laundry cycles contemplated for use in a laundry appliance 12. It is contemplated that the laundry cycles 132 are generally configured as various drying cycles of the laundry appliance 12 configured to ultimately dry the articles 28. The pet hair cycle 134 is configured to loosen and remove the foreign particulates 92 from the articles 28. The foreign particulates 92 can include, but are not limited to, pet hair disposed on the articles 28.

It is generally contemplated that the pet hair cycle 134 may be configured to activate the fluid emitting feature 24 before, during, and/or after the laundry cycle 132 of the laundry appliance 12. For example, the fluid 22 may be dispensed in bursts throughout the pet hair cycle 134. Typically, the fluid emitting feature 24 is activated at the beginning of the laundry cycle 132 so that the fluid 22 can readily saturate the articles 28 and the foreign particulate 92, such as pet hair. The fluid 22 can be used to diminish the electrostatic characteristics of the foreign particulate 92 and lessen the adhesive properties of the foreign particulate 92. In this manner, the controller 26 may activate the fluid emitting feature 24 at a start of the pet hair cycle 134. Subsequently, over the course of the pet hair cycle 134 bursts of fluid 22 can be a series of pulsating bursts of fluid 22 that are configured to detach the foreign particulates 92 from the articles 28. The foreign particulates 92 may enter the airflow path 64 once removed from the articles 28 and subsequently be collected on the air filter 98. Additionally or alternatively, the bursts of fluid 22 can be dispensed intermittently and/or continuously and can be dispensed automatically before, during, and/or after one of the laundry cycles 132. In some configurations, a user can refill the fluid housing 20 with additional fluid 22 upon dissipation and/or depletion of the stored fluid 22.

Referring again to FIGS. 1-5, the fluid 22 is configured to dampen and/or maintain a dampness of the articles 28 while the air path 64 otherwise assists in separation and removal of the foreign particulates 92 from the articles 28 and the drum 16. It is generally contemplated that the foreign particulates 92 dry at a faster rate as compared to the articles 28, and the airflow path 64 may lift the foreign particulates 92 from the articles 28. The drum 16 may include the moisture sensor 18 that is configured to detect a wetness of the articles 28 within the processing space 72. The moisture sensor 18 is communicatively coupled to the controller 26 to transmit the detected wetness of the articles 28.

The controller 26 may utilize the detected wetness to control the distribution of the fluid 22 into the processing space 72 via the fluid emitting feature 24. The memory 122 of the controller 26 may be configured with a predetermined wetness of the articles 28. The predetermined wetness can correspond to a point in the pet hair cycle 134 in which the articles 28 are drying, but still damp, and the foreign particulate 92 can be substantially dry to be separated therefrom. The controller 26 can activate the fluid emitting feature 24 to dampen the articles 28 while the foreign particulates 92 are loosened via the airflow path 64. It is generally contemplated that the controller 26 is configured to selectively and intermittently activate the fluid emitting feature 24 throughout the pet hair cycle 134. The controller 26 may specifically activate the fluid emitting feature 24 selectively and intermittently in response to the detected wetness of the articles 28.

The invention disclosed herein is further summarized in the following paragraphs and is further characterized by combinations of any and all of the various aspects described therein.

According to an aspect of the present disclosure, a foreign particulate removal assembly for a laundry appliance includes a cabinet, a drum that is disposed within the cabinet and has a processing space defined therein, a moisture sensor in communication with the processing space, a fluid housing that is disposed within the cabinet proximate the drum, and a fluid emitting feature that is operably coupled to the fluid housing and positioned proximate the drum. The fluid emitting feature selectively delivers a particulate separating fluid from the fluid housing and onto the processing space of the drum. The fluid emitting feature is in communication with the moisture sensor and the fluid emitting feature activates when the moisture sensor senses a threshold level of moisture within the processing space.

According to another aspect, a controller is communicatively coupled with the fluid emitting feature and the moisture sensor. The controller is configured to activate the fluid emitting feature when the moisture sensor detects the threshold level of moisture within the processing space.

According to another aspect, the threshold level of moisture is indicative of a predetermined ratio of wash fluid present within articles being processed within the processing space.

According to another aspect, the controller includes a memory that is configured with routines, wherein the routines include a pet hair cycle.

According to another aspect, the controller is configured to activate the fluid emitting feature at a start of the pet hair cycle.

According to another aspect, the controller is configured to intermittently activate the fluid emitting feature throughout the pet hair cycle.

According to another aspect, the moisture sensor is at least one of a humidity sensor and a conductivity sensor.

According to another aspect, the particulate separating fluid includes at least one of an anti-static spray, a water-vinegar solution and a fluid-air solution.

According to another aspect, a particulate separating fluid is dispenses as one of a mist and a vapor into the processing space.

According to another aspect, a particulate separating fluid is dispenses during a rotational operation of the drum about a rotational axis to define a particulate removal cycle.

According to another aspect, the particulate removal cycle includes rotating the drum about the rotational axis in a predetermined pattern.

According to another aspect, the predetermined pattern includes at least one of a clockwise rotation, a counterclockwise rotation, and a stationary state.

According to another aspect, the foreign particulate removal assembly further includes a blower that delivers process air through an airflow path that includes the processing space. The blower activates after the fluid emitting feature completes a particulate removal cycle, and the process air moves separated particulate from articles and delivers the separated particulate into an air filter that is positioned within the airflow path.

According to another aspect, the air filter is a removable mesh filter that is disposed proximate the drum.

According to another aspect, a fluid supply conduit extends between the fluid housing and the fluid emitting feature.

According to another aspect of the present disclosure, a foreign particulate removal assembly for a laundry appliance includes a cabinet, a drum that is disposed within the cabinet and has a processing space defined therein, a blower that delivers process air through an airflow path that includes the processing space, a moisture sensor in communication with the processing space, a fluid housing that is disposed within the cabinet proximate the drum, a fluid emitting feature that is operably coupled to the fluid housing and positioned proximate the drum, and a controller that is communicatively coupled with the fluid emitting feature and the moisture sensor. The controller is configured to activate the fluid emitting feature when the moisture sensor detects a threshold level of moisture within the processing space. The fluid emitting feature selectively delivers a particulate separating fluid from the fluid housing and onto the processing space of the drum.

According to another aspect, the blower activates after the fluid emitting feature completes a particulate removal cycle. The process air moves separated particulate from articles and delivers the separated particulate into an air filter that is positioned within the airflow path.

According to another aspect, the controller includes a memory that is configured with routines, and the routines include a pet hair cycle. The controller is configured to activate the fluid emitting feature at a start of the pet hair cycle.

According to another aspect, the controller is configured to intermittently activate the fluid emitting feature through the pet hair cycle.

According to another aspect of the present disclosure, a foreign particulate removal assembly for a laundry appliance includes a cabinet, a drum that is disposed within the cabinet and has a processing space defined therein, a blower that delivers process air through an airflow path that includes the processing space, a moisture sensor in communication with the processing space, a fluid housing that is disposed within the cabinet proximate the drum, and a fluid emitting feature that is operably coupled to the fluid housing and positioned proximate the drum. The fluid emitting feature selectively delivers a particulate separating fluid from the fluid housing and onto the processing space of the drum. The particulate separating fluid is delivered at a start of a pet hair cycle and intermittently delivers additional amounts of the particulate separating fluid during performance of the pet hair cycle.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. A foreign particulate removal assembly for a laundry appliance, the foreign particulate removal assembly comprising:

a cabinet;

a drum disposed within the cabinet and having a processing space defined therein;

a chemistry dispensing system disposed within the cabinet and that is in fluid communication with the processing space;

a moisture sensor in communication with the processing space;

a fluid housing disposed within the cabinet proximate the drum; and a fluid emitting feature operably coupled to the fluid housing and positioned proximate the drum, wherein the fluid emitting feature selectively delivers a particulate separating fluid from the fluid housing and onto the processing space of the drum, wherein the fluid emitting feature is in communication with the moisture sensor and wherein the fluid emitting feature activates when the moisture sensor senses a threshold level of moisture within the processing space, wherein the fluid housing and the fluid emitting feature are separate from the chemistry dispensing system, wherein the fluid emitting feature is configured to activate during a drying cycle of a laundry processing cycle.

2. The foreign particulate removal assembly of claim 1, further comprising:

a controller communicatively coupled with the fluid emitting feature and the moisture sensor, wherein the controller is configured to activate the fluid emitting feature when the moisture sensor detects the threshold level of moisture within the processing space.

3. The foreign particulate removal assembly of claim 1, wherein the threshold level of moisture is indicative of a predetermined ratio of wash fluid present within articles being processed within the processing space.

4. The foreign particulate removal assembly of claim 2, wherein the controller includes a memory that is configured with routines, and wherein the routines include a pet hair cycle of the drying cycle.

5. The foreign particulate removal assembly of claim 4, wherein the controller is configured to activate the fluid emitting feature at a start of the pet hair cycle.

6. The foreign particulate removal assembly of claim 4, wherein the controller is configured to intermittently activate the fluid emitting feature throughout the pet hair cycle.

7. The foreign particulate removal assembly of claim 1, wherein the moisture sensor is at least one of a humidity sensor and a conductivity sensor.

8. The foreign particulate removal assembly of claim 1, wherein the particulate separating fluid includes at least one of an anti-static spray, a water-vinegar solution and a fluid-air solution.

9. The foreign particulate removal assembly of claim 1, wherein a particulate separating fluid is dispensed as one of a mist and a vapor into the processing space.

10. The foreign particulate removal assembly of claim 1, wherein a particulate separating fluid is dispensed during a rotational operation of the drum about a rotational axis to define a particulate removal cycle.

11. The foreign particulate removal assembly of claim 10, wherein the particulate removal cycle includes rotating the drum about the rotational axis in a predetermined pattern.

12. The foreign particulate removal assembly of claim 11, wherein the predetermined pattern includes at least one of a clockwise rotation, a counterclockwise rotation and a stationary state.

13. The foreign particulate removal assembly of claim 1, further comprising a blower that delivers process air through an airflow path that includes the processing space, wherein the blower activates after the fluid emitting feature completes a particulate removal cycle, and wherein the process air moves separated particulate from articles and delivers the separated particulate into an air filter that is positioned within the airflow path.

14. The foreign particulate removal assembly of claim 13, wherein the air filter is a removable mesh filter that is disposed proximate the drum.

15. The foreign particulate removal assembly of claim 1, wherein a fluid supply conduit extends between the fluid housing and the fluid emitting feature.

16. A foreign particulate removal assembly for a laundry appliance, comprising:

a cabinet;

a drum disposed within the cabinet and having a processing space defined therein;

a blower that delivers process air through an airflow path that includes the processing space;

a moisture sensor in communication with the processing space;

a fluid housing disposed within the cabinet proximate the drum;

a fluid emitting feature operably coupled to the fluid housing and positioned proximate the drum; and a controller communicatively coupled with the fluid emitting feature and the moisture sensor, wherein the controller is configured to activate the fluid emitting feature when the moisture sensor detects a threshold level of moisture within the processing space, wherein the fluid emitting feature selectively delivers a particulate separating fluid from the fluid housing and onto the processing space of the drum, wherein the fluid housing and the fluid emitting feature are separate from a chemistry dispensing system that is in communication with the processing space, and wherein the controller activates the fluid emitting feature during a pet hair removal drying cycle of a laundry processing cycle.

17. The foreign particulate removal assembly of claim 16, wherein the blower activates after the fluid emitting feature completes a particulate removal cycle, and wherein the process air moves separated particulate from articles and delivers the separated particulate into an air filter that is positioned within the airflow path.

18. The foreign particulate removal assembly of claim 16, wherein the controller includes a memory that is configured with routines, and wherein the routines include the pet hair removal drying cycle, wherein the controller is configured to activate the fluid emitting feature at a start of the pet hair removal drying cycle.

19. The foreign particulate removal assembly of claim 18, wherein the controller is configured to intermittently activate the fluid emitting feature throughout the pet hair removal drying cycle.

20. A foreign particulate removal assembly for a laundry appliance, comprising:

a cabinet;

a drum disposed within the cabinet and having a processing space defined therein;

a chemistry dispensing system that is in communication with the processing space;

a blower that delivers process air through an airflow path that includes the processing space;

a moisture sensor in communication with the processing space;

a fluid housing disposed within the cabinet proximate the drum; and a fluid emitting feature operably coupled to the fluid housing and positioned proximate the drum and separate from the chemistry dispensing system, wherein the fluid emitting feature is configured to selectively deliver a particulate separating fluid from the fluid housing and onto the processing space of the drum, wherein the particulate separating fluid is delivered at a start of a pet hair removal drying cycle and intermittently delivers additional amounts of the particulate separating fluid during performance of the pet hair removal drying cycle.

* * * * *